US006232853B1

(12) United States Patent
Goulouev

(10) Patent No.: US 6,232,853 B1
(45) Date of Patent: May 15, 2001

(54) WAVEGUIDE FILTER HAVING ASYMMETRICALLY CORRUGATED RESONATORS

(75) Inventor: Rousslan Goulouev, Cambridge (CA)

(73) Assignee: COM DEV Limited, Cambridge (CA)

( * ) Notice: Subject to any disclaimer, the term of this patent is extended or adjusted under 35 U.S.C. 154(b) by 0 days.

(21) Appl. No.: 09/267,096

(22) Filed: Mar. 12, 1999

(51) Int. Cl.[7] ..... H01P 1/20

(52) U.S. Cl. ..... 333/208; 333/202; 333/34; 333/210

(58) Field of Search ..... 333/202, 208, 333/34, 210, 211, 212

(56) References Cited

U.S. PATENT DOCUMENTS

| | | | |
|---|---|---|---|
| 1,788,538 | 1/1931 | Norton | 333/167 |
| 1,849,656 | 3/1932 | Bennett | 333/168 |
| 2,540,488 | 2/1951 | Mumford | 333/209 |
| 2,585,563 | 2/1952 | Lewis et al. | 333/209 |
| 3,046,503 | 7/1962 | Cohn | 333/210 |
| 3,271,706 | 9/1966 | Rooney | 333/210 |
| 3,597,710 | 8/1971 | Levy | 333/210 |
| 3,621,483 | 11/1971 | Craven | 333/210 |
| 3,634,788 | 1/1972 | Craven | 333/210 |
| 3,639,862 | 2/1972 | Craven et al. | 333/210 |
| 3,819,900 | 6/1974 | Ironfield | 219/750 |
| 3,838,368 | 9/1974 | Ironfield | 333/210 |
| 3,949,327 | 4/1976 | Chapell | 333/210 |
| 4,155,056 | 5/1979 | Cross et al. | 333/195 |
| 4,492,020 | 1/1985 | Cobb | 29/600 |
| 4,626,809 | 12/1986 | Mizumura et al. | 333/202 |
| 4,646,039 | 2/1987 | Saad | 333/210 |
| 4,673,903 | 6/1987 | Saad | 333/210 |
| 4,749,973 | 6/1988 | Kaneko et al. | 333/210 |
| 5,004,993 | 4/1991 | Reindel | 333/208 |
| 5,243,618 | 9/1993 | Dolezal et al. | 372/92 |
| 5,357,591 | 10/1994 | Jiang et al. | 385/37 |
| 5,381,596 | 1/1995 | Ferro | 29/600 |
| 5,598,300 | 1/1997 | Magnusson et al. | 359/566 |
| 5,600,740 | 2/1997 | Asfar | 385/27 |
| 5,715,271 | 2/1998 | Huang et al. | 372/102 |
| 5,869,429 * | 2/1999 | Das | 505/210 |

FOREIGN PATENT DOCUMENTS

| | | |
|---|---|---|
| 3802578 | 8/1989 | (DE) . |
| 2190001 | 8/1988 | (JP) . |
| 63-166301 | 11/1988 | (JP) . |
| 6378601 | 10/1990 | (JP) . |

* cited by examiner

*Primary Examiner*—Benny Lee
*Assistant Examiner*—Kimberly E Glenn
(74) *Attorney, Agent, or Firm*—Jones, Day, Reavis & Pogue

(57) ABSTRACT

A waveguide filter is provided having a plurality of asymmetrical corrugated resonators. The filter may also include an input section and an output section including a low-pass filter unit and a transformer unit. The low-pass filter unit includes a plurality of symmetrically corrugated slots, and the transformer unit includes at least one stepped transformer section for matching the filter to an external waveguide line. Each of the asymmetrically corrugated resonators may include a pair of opposed slots of different depth, a long slot and a short slot. The resonators provide at least one reflection zero and two transmission zeros to the frequency response of the filter, thus providing high-pass, band-pass and low-pass filter properties in a single filter structure.

32 Claims, 5 Drawing Sheets

WAVEGUIDE FILTER HAVING ASYMMETRICALLY CORRUGATED RESONATORS

BACKGROUND OF THE INVENTION

1. Technical Field

The present invention is directed to the field of electronic filters. More particularly, the present invention provides a compact waveguide filter exhibiting high-pass, band-pass and low-pass response from a single filter structure, which is capable of handling high-powered microwave signals in the GHz frequency range.

2. Description of the Related Art

Waveguide filters are known in this art. There are two primary types of filters for use in the microwave frequency range (i.e. from about 2–15 GHz), symmetrically corrugated filters and iris filters. However, both of these types of filters suffer from many disadvantages.

An example of a symmetrically corrugated filter is shown in U.S. Pat. No. 3,597,710 to Levy ("the '720 patent). FIG. 1 of the '720 patent shows a standard E-plane corrugated structure having a uniform waveguide channel with a plurality of symmetrical corrugations. But as noted in the '720 patent, these types of corrugated filters are typically low-pass only. Such a filter typically cannot provide a band-pass response.

The '720 patent purports to have advantages over the standard corrugated structure by forming a plurality of capacitive irises. Instead of forming a uniform waveguide channel, the '720 patent provides a series of iris structures (FIGS. 2 and 6), which have different heights. Although the irises and the corrugations are of different height, for any one iris or corrugation, the structure is symmetrical. Another example of an iris filter (known as an H-plane iris filter) is shown in U.S. Pat. No. 2,585,563 to Lewis, et al. These types of iris filters suffer from many disadvantages, however. First, they typically provide band-pass response only, i.e., they are incapable of providing a combination response, such as low-pass and band-pass. Secondly, the iris filter is typically a large structure, as the irises are generally separated along the waveguide channel by a half of a wavelength ($\lambda g/2$). Since the number of irises typically correlates to the order of the filter, this results in a very large filter when the order of the filter is high, such as 5th order or greater.

Other types of filters include resonant iris filters (as shown in U.S. Pat. Nos. 1,788,538 to Norton and 1,849,659 to Bennett) and evanescent-mode ridged filters (as shown in U.S. Pat. No. 4,646,039 to Saad). The resonant iris filter utilizes a plurality of resonant diaphragms as resonating elements that are separated by a quarter of a wavelength ($\lambda g/4$). The evanescent-mode ridged filter is based on a wavelength structure with a ridged cross section. However, a common problem with both of these types of filters is that they typically cannot handle high-powered signals.

Therefore, there remains a general need in this field for a compact waveguide filter that provides a combination response and is capable of handling high-powered signals in the GHz range.

SUMMARY OF THE INVENTION

A waveguide filter is provided having a plurality of asymmetrical corrugated resonators. The filter may also include an input section and an output section including a low-pass filter unit and a transformer unit. The low-pass filter unit includes a plurality of symmetrically corrugated slots, and the transformer unit includes at least one stepped transformer section for matching the filter to an external waveguide line. Each of the asymmetrically corrugated resonators may include a pair of opposed slots of different depth, a long slot and a short slot. The resonators provide at least one reflection zero and two transmission zeros to the frequency response of the filter, thus providing high-pass, band-pass and low-pass filter properties in a single filter structure.

According to one aspect of the invention, a waveguide filter is provided that includes an input section, an output section and a band-pass filter unit coupled between the input and output sections. The input section includes a transformer unit and a low-pass filter unit, wherein the transformer unit includes at least one stepped transformer section for matching the input section of the waveguide filter to an external waveguide line, and the low-pass filter unit includes a plurality of symmetrically corrugated slots. The output section also includes a low-pass filter unit and a transformer unit, wherein the low pass-filter unit includes a plurality of symmetrically corrugated slots, and the transformer unit includes at least one stepped transformer section for matching the output section of the waveguide filter to an external waveguide line. And the band-pass filter unit includes a plurality of asymmetrically corrugated resonators, each resonator having a long slot and a short slot.

Another aspect of the invention provides a waveguide filter having an input section and an output section coupled to external waveguide lines, and a band-pass filter unit coupled between the input section and the output section, the band-pass filter having N asymmetrically corrugated resonators, wherein each resonator provides one reflection zero and two transmission zeros to the frequency response of the waveguide filter.

Still another aspect of the invention provides a filter having a plurality of asymmetrically corrugated resonators having two opposed slots of different depth, a long slot and a short slot.

It should be noted that these are just some of the many aspects of the present invention. Other aspects not specified will become apparent upon reading the detailed description set forth below.

The present invention overcomes the disadvantages of presently known filters and also provides many advantages, such as: (1) compact size; (2) high-powered capability; (3) combination frequency response; (4) sharp roll-off on both sides of the pass band; (5) wide and deep rejection response; (6) optional addition of extra low-pass rejection; (7) optional transformer units; and (8) exhibits narrower spurious pass band corresponding to high-order modes than conventional filters.

These are just a few of the many advantages of the present invention, which is described in more detail below in terms of the preferred embodiments. As will be appreciated, the invention is capable of other and different embodiments, and its several details are capable of modifications in various respects, all without departing from the spirit of the invention. Accordingly, the drawings and description of the preferred embodiments set forth below are to be regarded as illustrative in nature and not restrictive.

BRIEF DESCRIPTION OF THE DRAWINGS

The present invention satisfies the general need noted above and provides many advantages, as will become apparent from the following description when read in conjunction with the accompanying drawings, wherein.

DETAILED DESCRIPTION OF THE DRAWINGS

Figure 1:
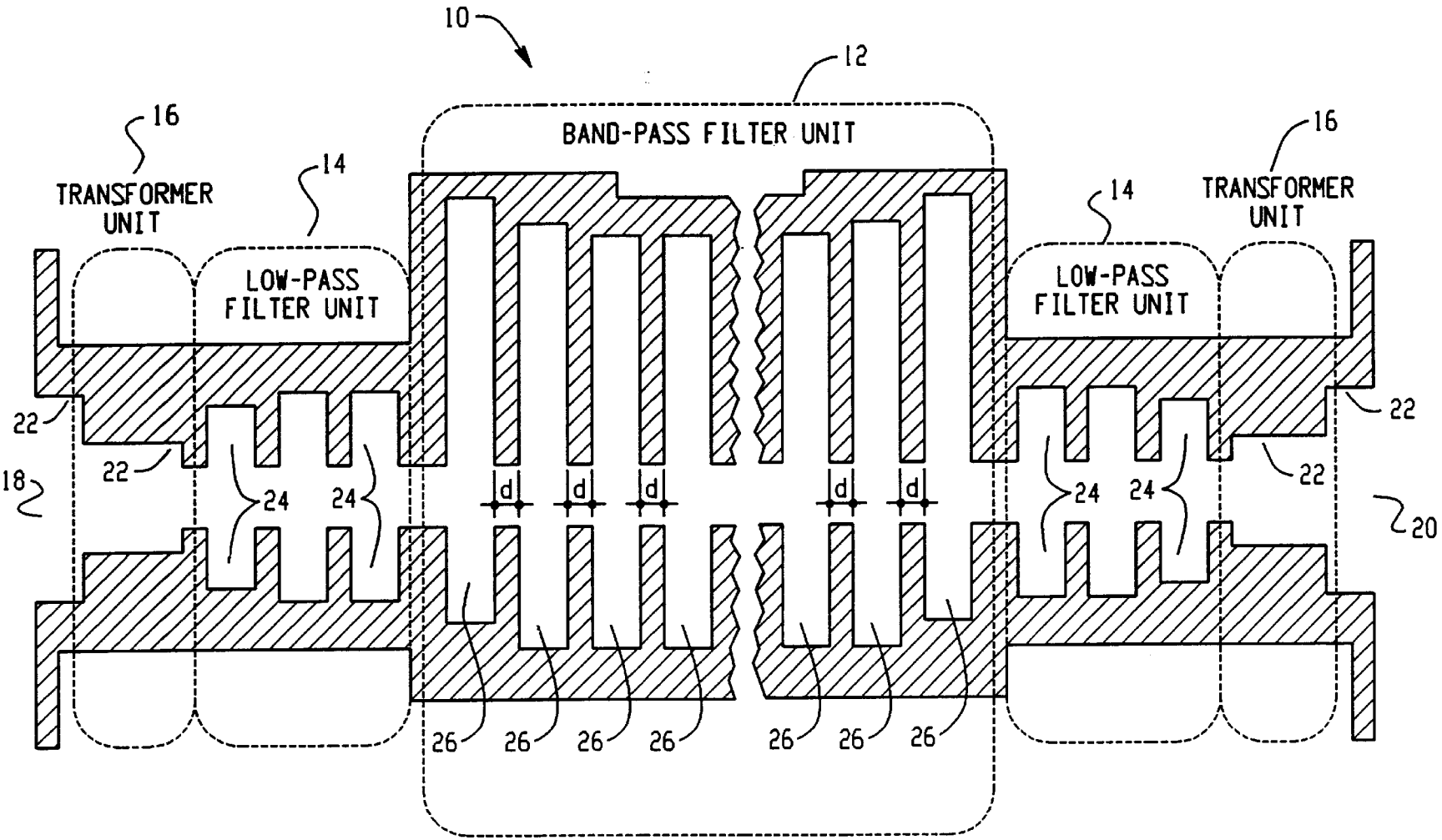
FIG. 1 is an E-plane cross-section of a waveguide filter according to the present invention, having a plurality of asymmetrically corrugated resonators.

Turning now to the drawing figures, FIG. 1 is an E-plane cross-section of a waveguide filter 10 according to the present invention, having a plurality of asymmetrically corrugated resonators 26. The waveguide filter 10 preferably includes an input section 18 and an output section 20. Coupled between the input section 18 and the output section 20 is a preferred band-pass filter unit 12. Connecting the input section 18, band-pass filter unit 12 and the output section 20 is a uniform waveguide channel through which electromagnetic energy is passed. Although the filter 10 preferably operates in the microwave region between 2 and 15 GHz, it could easily operate at other frequencies, and the present invention is not limited to any particular frequency range of operation.

Each of the input section 18 and output section 20 may include a transformer unit 16 or a low-pass filter unit 14, or both in combination. The transformer units 16 are preferably stepped impedance quarter-wave transformers used to match the filter 10 with external waveguide lines (not shown). Each transformer unit 16 may comprise one or more stepped transformer sections 22 depending upon the size mismatch between the filter 10 and the external waveguide lines. For certain types of filters 10, the transformer unit can be entirely omitted. Alternatively, the transformer units 16 could be integrated into the filter 10 as additional reflection zero resonators, which would increase the order of the filter.

The low-pass filter units 14, like the transformer units 16, are optional elements of the inventive filter 10. Each of the low-pass filters 14 is preferably a shallow-slot symmetrically corrugated filter. The purpose of adding these low-pass filters 14 is to provide additional rejection in certain frequency bands that correspond to multiple harmonics of the pass-band (which is determined by the band-pass filter unit 12). If the rejection provided by the band-pass filter unit 12 is sufficient for the particular application of filter 10, then these units 14 can be omitted.

Coupling the input section 18 to the output section 20 is the band-pass filter unit 12. The band-pass filter unit 12 includes a plurality (N) of asymmetrically corrugated resonators 26, each resonator separated by a distance (d) that can be much smaller than $\lambda g/4$. Because the resonators 26 can be spaced very close together, the present invention can provide a high-order filter that is much smaller than comparable iris or symmetrically corrugated filters. For example, a 15th order Ku-Band filter (N=15) constructed according to the present invention would be approximately 2.5 inches in length, whereas a comparable Ku-Band 15th order iris filter would be approximately 11.5 inches in length.

The band-pass filter unit 12 provides N reflection zero's in the pass band, N transmission zeros between the waveguide cut-off frequency and pass band, and N transmission zeros above the pass band, where N is the number of asymmetrically corrugated resonators 26 in the filter 10. In general, the number of resonators N corresponds to the order of the filter. The reflection zeros may form a Chebychev or maximally flat frequence response in the pass band, and the transmission zeros form deep rejection bands on both sides of the pass band. In this manner, the single filter structure 12 provides a combination high-pass, low-pass and band-pass frequency response. Such a frequency response combination is not possible with prior art filter technologies.

Figure 2:
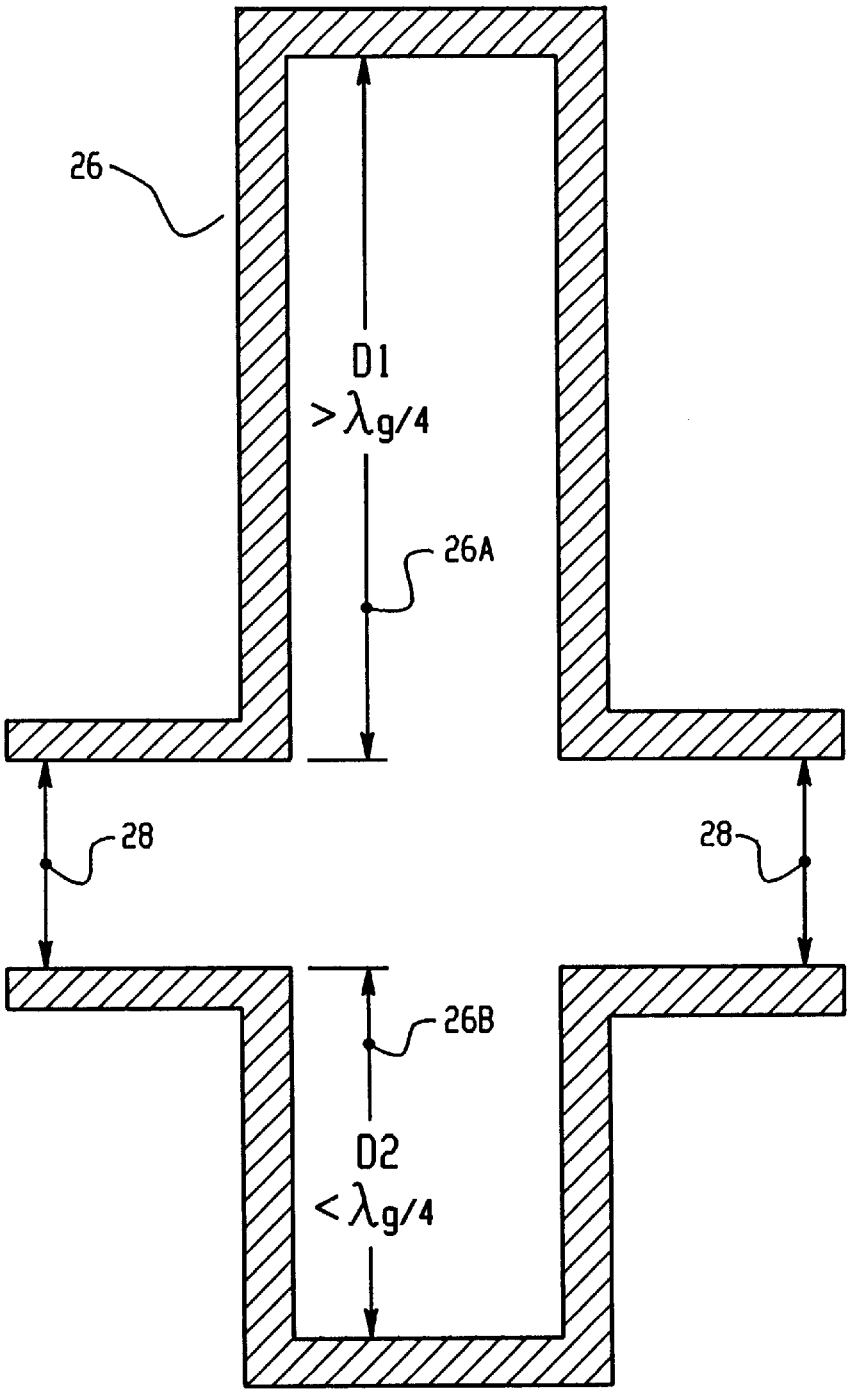
FIG. 2 is a cross-section of one of the plurality of asymmetrically corrugated resonators.

FIG. 2 is a cross-section of one of the plurality of asymmetrically corrugated resonators 26. The resonator 26 includes a pair of opposed slots 26A, 26B, which span the waveguide channel 28. The two opposed slots 26A, 26B are asymmetrical in depth, meaning that one of the slots is deeper than the other. The longer of the two slots 26A is termed the "long slot" and the shorter of the two slots 26B is termed the "short slot." Preferably, the depth (D1) of the long slot 26A is greater than $\lambda g/4$, and the depth (D2) of the short slot 26B is shorter than $\lambda g/4$.

The depths (D1), (D2) of the long and short slots are selected in order to position the reflection zero within the desired filter pass band, and the two transmission zeros on either side of the pass band. The depths D1 and D2 can vary for each resonator, such that some of the resonators may have the same structure, although depending on the design of the filter and the desired characteristics, the depths D1, D2 for each resonator 26 could be different values. The actual values of D1 and D2 for each resonator are determined by computer modeling. The loaded Q factor of each resonator 26 is then determined by the slope of the reflection response at the reflection zero point. The position of the transmission zero at the lower frequency of the pass band is determined by the depth (D1) of the long slot 26A, and the position of the transmission zero at the higher frequency of the pass band is determined by the depth (D2) of the short slot 26B. Having transmission zeros on both sides of the pass band makes the filter roll-off response sharper and its rejection wider and deeper.

As noted above, the distance (d) between the resonators 26 can be reduced to much less than $\lambda g/4$, without detriment to the band-pass filter response, thus resulting in a filter that is very compact in comparison to prior art filters. In addition, the reduction in (d) between the resonators makes the bandwidth of the filter wider, which is a desirable feature.

Figure 3:
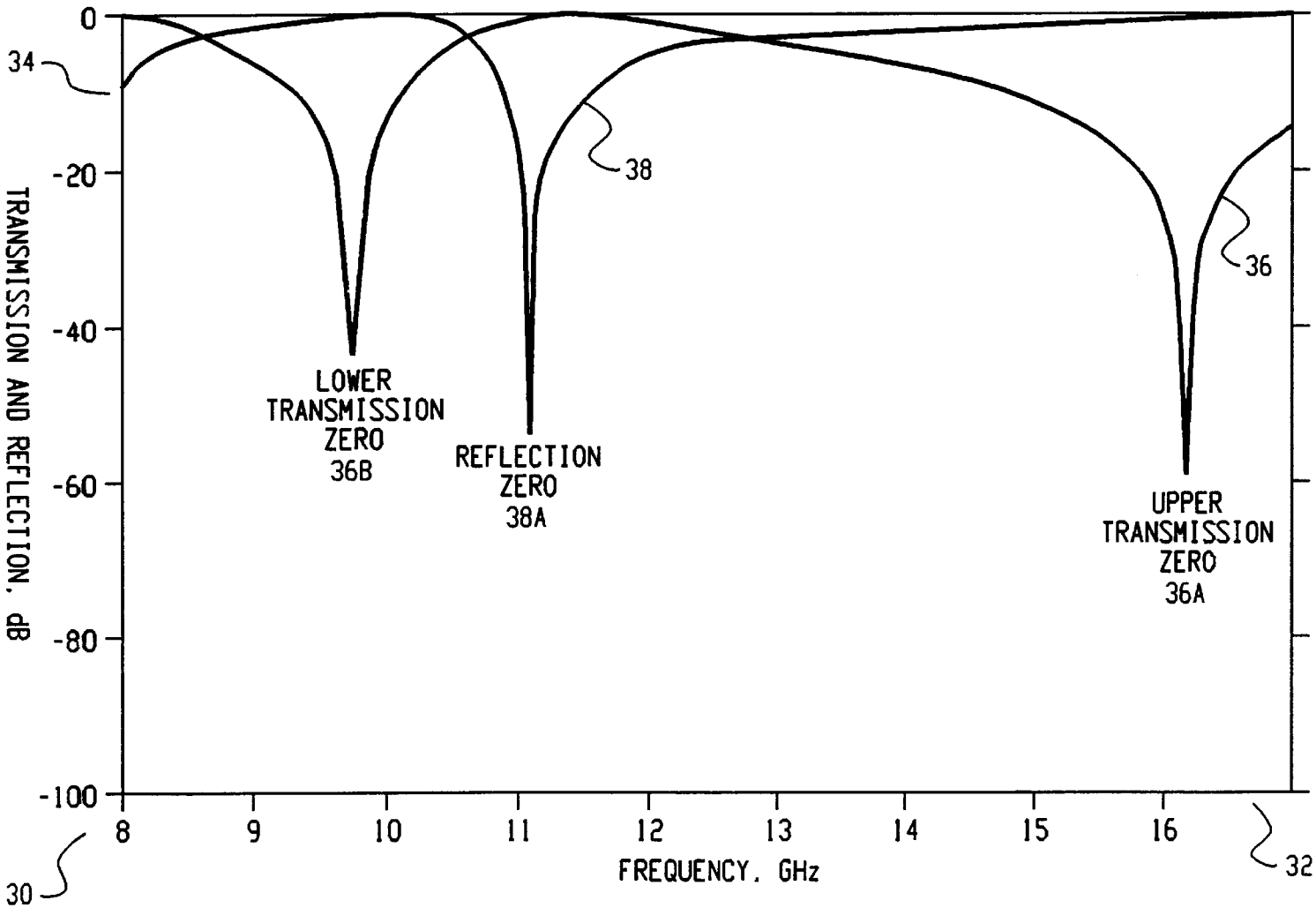
FIG. 3 is a plot of the frequency response of one of the asymmetrically corrugated resonators.

FIG. 3 is a plot 30 of the frequency response of one of the asymmetrically corrugated resonators 26. The x-axis 32 of the plot shows frequency (GHz), and the y-axis shows transmission and reflection response (dB). As seen in this plot, the transmission characteristic 36 for each resonator includes a first transmission zero at a relatively lower frequency 36B and a second transmission zero at a relatively higher frequency 36A. These transmission zeros provide the high-pass and low-pass response of the filter, and ensure a steep roll-off on either side of the pass band. The reflection characteristic 38 includes a reflection zero 38A within the pass band of the filter. Each resonator 26 contributes one reflection zero and two transmission zeros to the frequency response of the overall filter, which when they are superimposed, provides the desired frequency response as shown in FIGS. 4 and 5.

Figure 4:
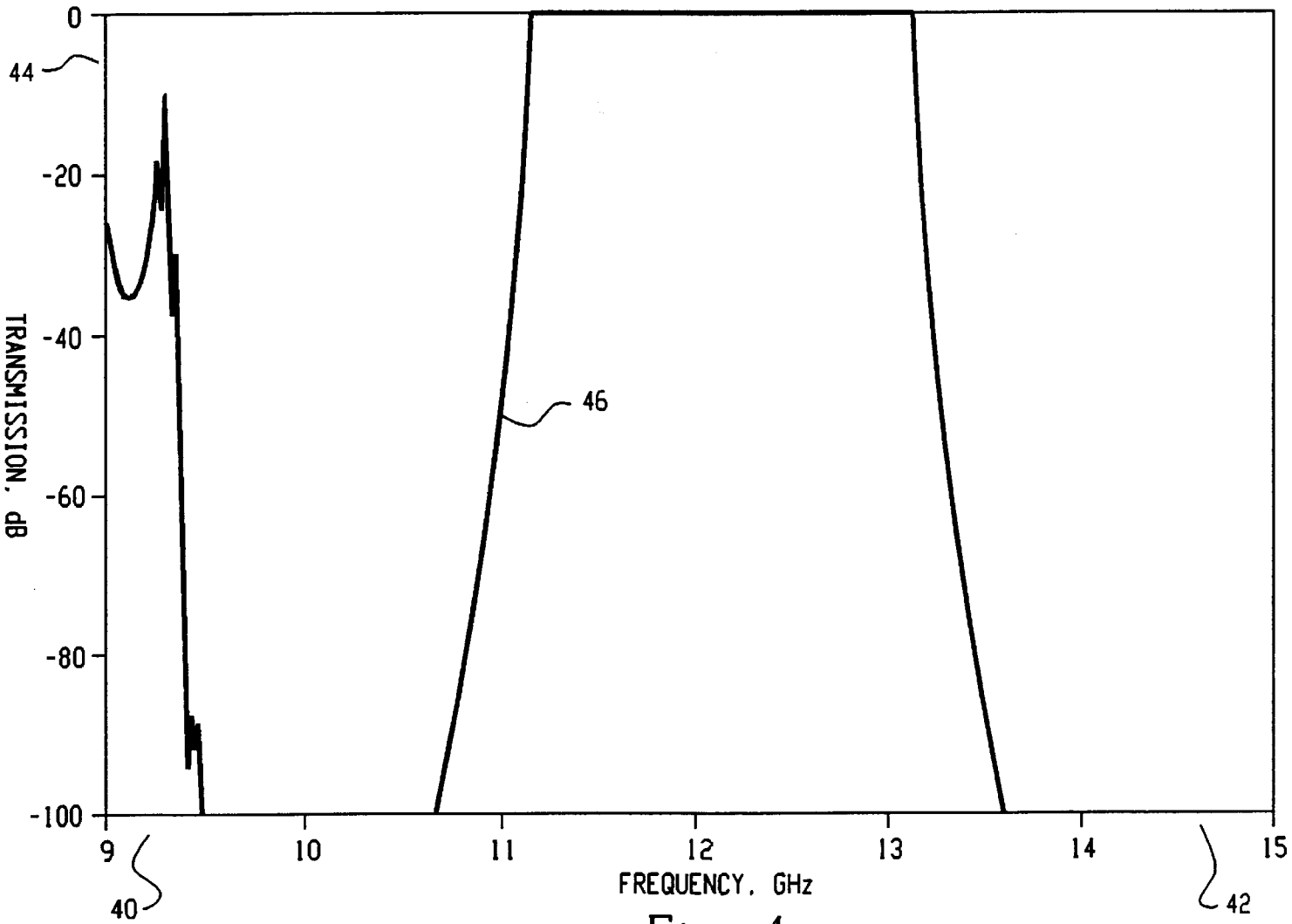
FIG. 4 is a plot of the transmission response of the waveguide filter shown in FIG. 1.

FIG. 4 is a plot 40 of the transmission response of the waveguide filter 10 shown in FIG. 1. The x-axis 42 of the plot shows frequency (GHz), and the y-axis 44 shows transmission response (dB). As seen in this plot, the transmission response shows a pass band between about 11 and 13 GHz, which drops sharply to −100 dB on either side of the pass band. This sharp roll-off is created by the N transmission zeros on either side of the pass band. Also seen in the plot is what is known as "spurious passband" near the waveguide's cut-off frequency. The location on the frequency axis 42 where this spurious passband appears depends on the width of the internal corrugated structure and the positioning of the dominant mode within the pass band. The filter of the present invention may demonstrate narrower spurious pass band than conventional low-pass filters due to the depression caused by the N transmission zeros.

Figure 5:
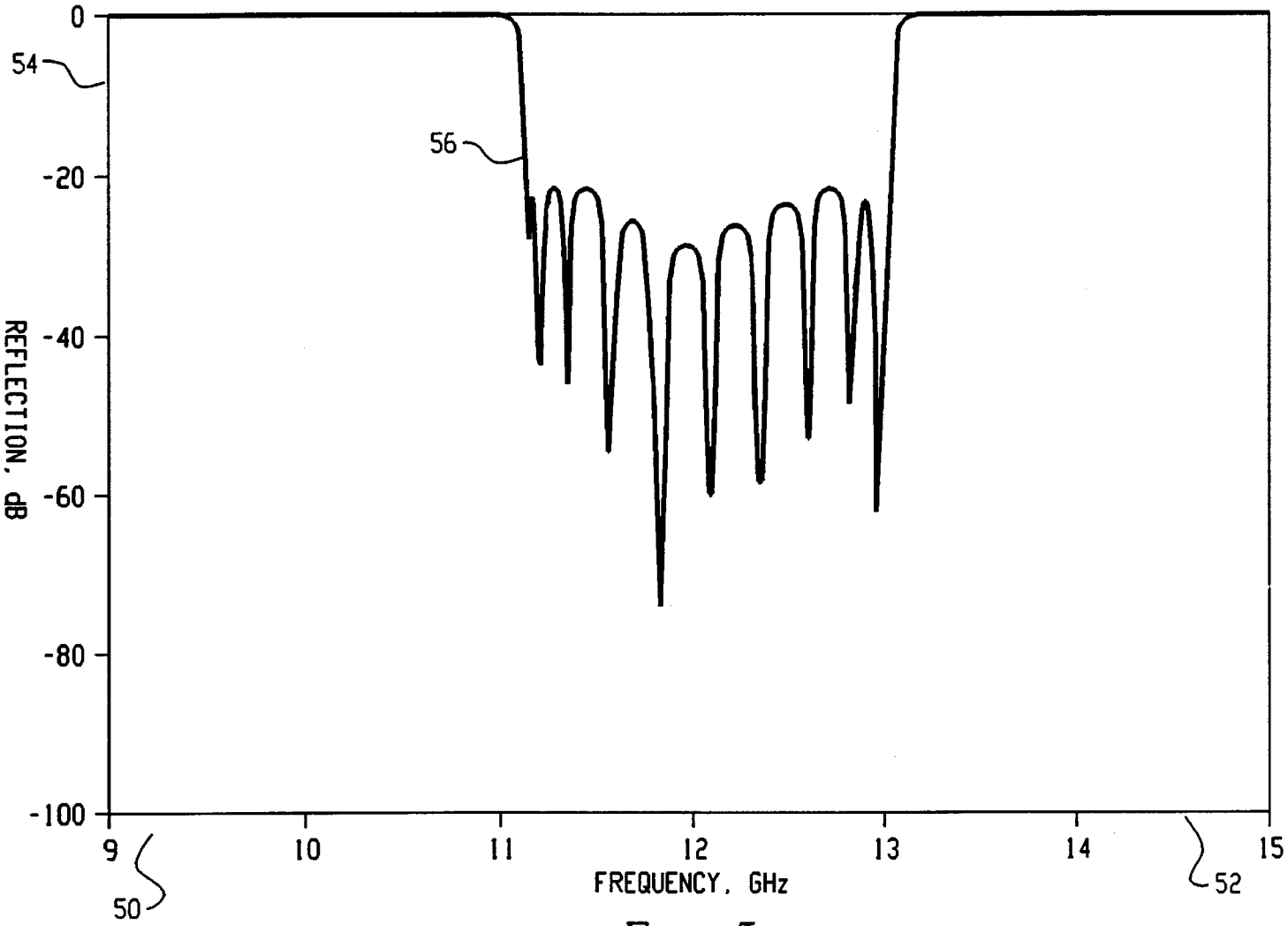
FIG. 5 is a plot of the reflection response of the waveguide filter shown in FIG. 1.

FIG. 5 is a plot 50 of the reflection response of the waveguide filter 10 shown in FIG. 1. The x-axis 52 of the plot shows frequency (GHz), and the y-axis 54 shows reflection response (dB). As seen in this plot, the reflection response is 0 dB across most of the frequency range, except in the pass band, where the reflection response increases sharply to between =20 and =60 dB, providing the expected pass band suppression of reflected energy.

As these plots show, the filter of the present invention provides a unique combination frequency response including low-pass, band-pass and high-pass characteristics. These characteristics are determined by the structure of the individual asymmetric resonators 26, each of which contributes to the low-pass, band-pass and high-pass frequency response of the overall filter 10.

The preferred embodiment of the invention described with reference to the drawing figures is presented only as an example of the inventive technology, which is only limited by the claims. Other elements, steps, methods and techniques that are insubstantially different from those described herein are also within the scope of the present invention.

What is claimed:

1. A waveguide filter, comprising:

an input section including a transformer unit and a low-pass filter unit, wherein the transformer unit includes at least one stepped transformer section for matching the input section of the waveguide filter to an external waveguide line, and the low-pass filter unit includes a plurality of symmetrically corrugated slots;

an output section including a low-pass filter unit and a transformer unit, wherein the low pass-filter unit includes a plurality of symmetrically corrugated slots, and the transformer unit includes at least one stepped transformer section for matching the output section of the waveguide filter to an external waveguide line; and a band-pass filter unit coupled between the input section and the output section, wherein the band-pass filter unit includes a plurality of asymmetrically corrugated resonators, each resonator having a long slot and a short slot.

2. The waveguide filter of claim 1, wherein each of the asymmetrically corrugated resonators contributes one reflection zero and two transmission zeros to the frequency response of the filter.

3. The waveguide filter of claim 2, wherein one of the transmission zeros is at a relatively lower frequency and the other of the transmission zeros is at a relatively higher frequency.

4. The waveguide filter of claim 3, wherein the frequency of the transmission zero at the relatively lower frequency is determined by the depth of the long slot of the asymmetrically corrugated resonator.

5. The waveguide filter of claim 3, wherein the frequency of the transmission zero at the relatively higher frequency is determined by the depth of the short slot of the asymmetrically corrugated resonator.

6. The waveguide filter of claim 1, wherein at least one of the asymmetrically corrugated resonators is characterized by a long slot having a depth that is less than the depth of the long slot of at least one of the other asymmetrically corrugated resonators.

7. The waveguide filter of claim 1, wherein at least one of the asymmetrically corrugated resonators is characterized by a short slot having a depth that is less than the depth of the short slot of at least one of the other asymmetrically corrugated resonators.

8. The waveguide filter of claim 1, wherein the distance between each of the plurality of asymmetrically corrugated resonators is less than one quarter of the wavelength of electromagnetic energy being passed within the pass band of the band-pass filter unit.

9. The waveguide filter of claim 1, wherein the depth of the long and short slots of each asymmetrically corrugated resonator determines the loaded quality factor of that resonator.

10. The waveguide filter of claim 1, wherein the number of asymmetrically corrugated resonators determines the order of the band-pass filter.

11. A waveguide filter, comprising:

input section and an output section coupled to external waveguide lines; and a band-pass filter unit coupled between the input section and the output section, the band-pass filter having N asymmetrically corrugated resonators, wherein each resonator provides one reflection zero and two transmission zeros to the frequency response of the waveguide filter, wherein each of the N resonators includes two opposed slots, a long slot characterized by a relatively long depth, and a short slot characterized by a relatively short depth in comparison to the long slot.

12. The waveguide filter of claim 11, wherein the depth of the long slot determines the frequency of one of the transmission zeros, and the depth of the short slot determines the frequency of the other transmission zero.

13. The waveguide filter of claim 12, wherein the frequency of the transmission zero that is determined by the depth of the long slot is at a lower frequency that the frequency of the transmission zero that is determined by the depth of the short slot.

14. A waveguide filter, comprising:

an input section and an output section coupled to external waveguide lines; and a band-pass filter unit coupled between the input section and the output section, the band-pass filter having N asymmetrically corrugated resonators, wherein each resonator provides one reflection zero and two transmission zeros to the frequency response of the waveguide filter, wherein the input section includes a transformer unit having at least one stepped transformer section for matching the input section of the waveguide filter to an external waveguide line.

15. A waveguide filter, comprising:

an input section and an output section coupled to external waveguide lines; and a band-pass filter unit coupled between the input section and the output section the band-pass filter having N asymmetrically corrugated resonators, wherein each resonator provides one reflection zero and two transmission zeros to the frequency response of the waveguide filter, wherein the output section includes a transformer unit having at least one stepped transformer section for matching the output section of the waveguide filter to an external waveguide line.

16. A waveguide filter, comprising:

an input section and an output section coupled to external waveguide lines; and a band-pass filter unit coupled between the input section and the output section, the band-pass filter having N asymmetrically corrugated resonators, wherein each resonator provides one reflection zero and two transmission zeros to the frequency response of the waveguide filter, wherein the input section includes a low-pass filter unit.

17. The waveguide filter of claim 16, wherein the low-pass filter unit includes a plurality of symmetrically corrugated slots.

18. A waveguide filter, comprising:

an input section and an output section coupled to external waveguide lines; and a band-pass filter unit coupled between the input section and the output section, the band-pass filter having N asymmetrically corrugated resonators, wherein each resonator provides one reflection zero and two transmission zeros to the frequency response of the waveguide filter, wherein the output section includes a low-pass filter unit.

19. The waveguide filter of claim 18, wherein the low-pass filter unit includes a plurality of symmetrically corrugated slots.

20. A waveguide filter comprising:

an input section and an output section coupled to external waveguide lines; and a band-pass filter unit coupled between the input section and the output section, the band-pass filter having N asymmetrically corrugated resonators, wherein each resonator provides one reflection zero and two transmission zeros to the frequency response of the waveguide filter, wherein the distance between each of the N asymmetrically corrugated resonators is less than one quarter of the wavelength of electromagnetic energy being passed within the pass band of the band-pass filter unit.

21. A waveguide filter, comprising:

an input section and an output section coupled to external waveguide lines; and a band-pass filter unit coupled between the input section and the output section, the band-pass filter having N asymmetrically corrugated resonators, wherein each resonator provides one reflection zero and two transmission zeros to the frequency response of the waveguide filter, wherein the order of the band-pass filter is determined by the value of N.

22. A waveguide filter, comprising:

an input section and an output section coupled to external waveguide lines; and a band-pass filter unit coupled between the input section and the output section, the band-pass filter having N asymmetrically corrugated resonators, wherein each resonator provides one reflection zero and two transmission zeros to the frequency response of the waveguide filter, wherein the band-pass filter provides a chebychev frequency response.

23. A filter, comprising:

a plurality of asymmetrically corrugated resonators having two opposed slots of different depth, a long slot and a short slot, wherein each of the asymmetrically corrugated resonators provides one reflection zero and two transmission zeros to the frequency response of the filter.

24. The filter of claim 23, wherein one of the transmission zeros is at a relatively lower frequency and the other of the transmission zeros is at a relatively higher frequency.

25. The filter of claim 24, wherein the frequency of the transmission zero at the relatively lower frequency is determined by the depth of the long slot.

26. The filter of claim 24, wherein the frequency of the transmission zero at the relatively higher frequency is determined by the depth of the short slot.

27. A filter, comprising:

a plurality of asymmetrically corrugated resonators having two opposed slots of different depth, a long slot and a short slot, wherein the distance between each of the plurality of asymmetrically corrugated resonators is less than one quarter of the wavelength of electromagnetic energy being passed within the pass band of the filter.

28. A filter, comprising:

a plurality of asymmetrically corrugated resonators having two opposed slots of different depth, a long slot and a short slot, further comprising two transformer units coupled to either end of the plurality of asymmetrically corrugated resonators for matching the filter to an external waveguide line.

29. The filter of claim 28, further comprising two low-pass filter units coupled between either end of the plurality of asymmetrically corrugated resonators and the two transformer units.

30. The filter of claim 28, wherein the low-pass filter units include a plurality of symmetrically corrugated slots.

31. A filter, comprising:

a plurality of asymmetrically corrugated resonators having two opposed slots of different depth, a long slot and a short slot, wherein the depth of the long and short slots of each asymmetrically corrugated resonator determines the loaded quality factor of that resonator.

32. A filter, comprising:

a plurality of asymmetrically corrugated resonators having two opposed slots of different depth a long slot and a short slot, wherein the order of the filter is determined by the number of asymmetrically corrugated resonators.

* * * * *

UNITED STATES PATENT AND TRADEMARK OFFICE

CERTIFICATE OF CORRECTION

PATENT NO. : 6,232,853 B1
DATED : May 15, 2001
INVENTOR(S) : Goulouev

It is certified that error appears in the above-identified patent and that said Letters Patent is hereby corrected as shown below:

Column 6,
Line 24, before "input" insert -- an --.
Line 60, after "sectin" insert -- , --.

Column 7,
Line 28, after "filter" insert -- ,--.

Column 8,
Line 52, after "depth" insert -- ,--.

Signed and Sealed this

Twenty-seventh Day of November, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,232,853 B1
DATED : May 15, 2001
INVENTOR(S) : Goulouev

It is certified that error appears in the above-identified patent and that said Letters Patent is hereby corrected as shown below:

Column 6,
Line 60, change "sectin" to -- section --

Signed and Sealed this

Twenty-fifth Day of March, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,232,853 B1 
DATED : May 15, 2001
INVENTOR(S) : Goulouev

It is certified that error appears in the above-identified patent and that said Letters Patent is hereby corrected as shown below:

Column 6,
Line 24, before "input" insert -- an --.
Line 60, after "section" insert -- , --.

Column 7,
Line 28, after "filter" insert -- , --.

Column 8,
Line 52, after "depth" insert -- , --.

This Certificate of Correction supercedes certificate issued November 27, 2001

Signed and Sealed this

Twenty-sixth Day of August, 2003

JAMES E. ROGAN
*Director of the United States Patent and Trademark Office*